United States Patent [19]

Sylvester et al.

[11] Patent Number: 4,491,062

[45] Date of Patent: Jan. 1, 1985

[54] ADJUSTABLE SLOT DIFFUSER

[75] Inventors: Gordon C. Sylvester, Verona; George E. Alexander, Madison, both of Wis.

[73] Assignee: Wehr Corporation, Milwaukee, Wis.

[21] Appl. No.: 563,034

[22] Filed: Dec. 19, 1983

[51] Int. Cl.[3] ..... F24F 13/06

[52] U.S. Cl. ..... 98/40 16; 98/40.12; 98/41.3

[58] Field of Search ..... 98/40 D, 40 R

[56] References Cited

U.S. PATENT DOCUMENTS

| | | | |
|---|---|---|---|
| 3,276,348 | 10/1966 | Kennedy | 98/40 D |
| 3,308,744 | 3/1967 | Schach | 98/40 D |
| 3,364,839 | 1/1968 | Sweeney et al. | 98/40 D |
| 3,411,425 | 11/1968 | Lambert | 98/40 D |
| 3,577,904 | 5/1971 | Lambert | 98/40 D |
| 3,601,033 | 8/1971 | Lambert | 98/40 D |
| 3,673,946 | 7/1972 | Ragland | 98/40 D |

FOREIGN PATENT DOCUMENTS

| | | | |
|---|---|---|---|
| 2225455 | 12/1973 | Fed. Rep. of Germany | 98/40 D |
| 1403229 | 8/1975 | United Kingdom | 98/40 D |

*Primary Examiner*—Albert J. Makay
*Assistant Examiner*—John Kwon

[57] ABSTRACT

An air diffuser includes first and second walls disposed in spaced side-by-side relationship and cooperating to define a passage for the flow of air in one direction between said walls. A pair of flanges extend towards each other from the downstream edges of the walls and defining an elongated outlet slot narrower than the width of said passage. A deflector vane is narrower than the passage and is disposed in the passage in a plane spaced upstream from the slot and generally parallel to said flanges. The deflector vane includes an inverted U-shaped central channel and flanges extending away from each other from the down stream ends of the U-shaped chanel and arranged generally parallel to the flanges defining the slot. The opposite ends of the vane are engaged in a U-shaped support with a spring engaging one wall of the U-shaped support and biasing the vane flanges into sliding engagement with the other wall. The vane thus being supported for back and forth edgewise movement in the plane to a first position in which the vane is closely adjacent to the first wall and spaced from the second wall, a second position in which the vane is closely adjacent the second wall, or selective positions between the two extremes.

8 Claims, 5 Drawing Figures

ADJUSTABLE SLOT DIFFUSER

BACKGROUND AND SUMMARY OF THE INVENTION

This invention relates to air distributors or diffusers for discharging air into a room and, more particularly, to diffusers including a narrow outlet slot and deflector vanes disposed in the diffuser above the outlet slot for varying the direction of air exiting through the outlet slot.

Deflector vanes have previously been formed from flat sheets of metal or from metal channels. Examples of such deflector vanes include Kennedy U.S. Pat. No. 3,276,348 and Lambert U.S. Pat. No. 3,411,425. These vanes are susceptible to bending and vibrating under the force of air impinging on the vanes.

This invention provides an improved deflector vane construction wherein the deflector vane is generally hat shaped in cross-section or, in other words, where the deflector vane includes an inverted U-shaped central channel and flanges extending away from each other from one end of the U-shaped channel, preferably the downstream end. This configuration provides a more structurally sound vane and one which strengthens the vane against bending or vibration. In addition, the stepped configuration of the ends of the deflector vane provides for better deflection of the airstream passing around the vane. The flat lateral flanges also provide a smooth sliding surface for moving the vane thereby eliminating problems such as may be encountered with channel-shaped deflector vanes of the edges of the vanes binding or catching on the support provided for mounting the deflector vane in the diffuser.

In one embodiment of the invention, the vane is wider than the outlet slot in the diffuser and the vane comprises a plurality of individual vane portions mounted along the length of the diffuser for individual adjustment to vary the direction of deflection of the air discharged through the outlet slot along the entire air diffuser length.

In another embodiment of the invention, the air distributor can include a pair of spaced apart but adjacent outlet slots which extend in parallel fashion along the length of the diffuser and the deflector vanes are disposed above each of the outlet slots.

DESCRIPTION OF THE PREFERRED EMBODIMENT

As illustrated in FIGS. 1, 2, 3 and 4, the invention comprises an air diffuser 10 adapted to be set into the ceiling or another wall in a room and to receive conditioned air through a supply duct 14.

Figure 2:
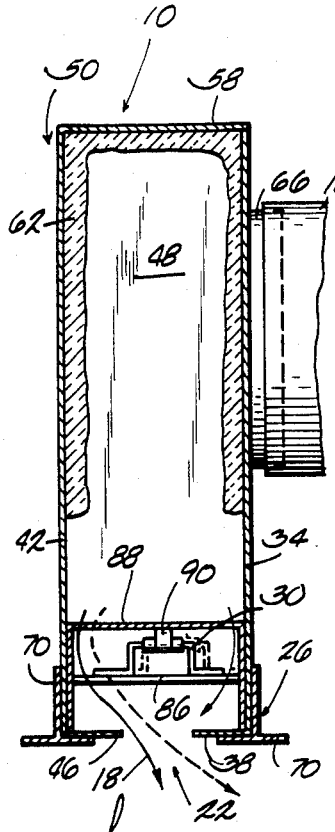
FIG. 2 is an end cross-sectional view taken along line 2—2 in FIG. 1.

As illustrated in FIG. 2, a stream of conditioned air is directed into the room through the diffuser 10, more specifically through an elongated slot 22 at the outer or downstream end 26 of the diffuser.

The direction of the air discharged into the room is controlled by means of an elongated deflector vane 30 located within the diffuser above, or upstream, of the outlet slot 22. The vane 30 can be positioned adjacent one or the other of the side walls 34 or 42 of the diffuser. When positioned at the extreme end in either of those operative positions, the air discharged into the room will have basically a horizontal throw and tend to move along the ceiling as it diffuses into the room. In this manner, the air being discharged through the slot 22 can have either a left or right throw, as viewed in FIG. 2. The vane can be positioned at any selected spot between those two extreme positions to vary the degree of horizontal throw and to afford a vertical component to the discharge of the air into the room. When the vane is centered between sidewalls 34 and 42, a vertical discharge of air into the room will result because the air separates relatively equally on opposite sides of the vane thereby cancelling out the horizontal components and resulting in a vertical discharge.

A more specific description of the diffuser structure and the operation thereof will now be made.

The diffuser comprises a sheet metal box 50 having horizontally extending, elongated vertical side walls 34 and 42 disposed in laterally spaced side-by-side relationship and joined together by two narrow end walls 54 and 56 and a top wall 58. Insulation 62 is attached to the side walls 34 and 42, end walls 54 and 56, and top wall 58 to minimize heat transfer between air inside the diffuser 10 and air surrounding the diffuser 10.

The supply duct 14 communicates with the passage 48 through an inlet connection 66 in the side wall 34 adjacent the top of the side wall 34. To regulate the rate at which air is discharged into the room, the diffuser 10 can include a damper (not shown) mounted in the inlet connection 66. The conditioned air flows downwardly through the passage 48 and toward the outlet slot 22 across the full length of the diffuser 10, as indicated by the arrows in FIG. 1.

The outlet slot 22 is defined between two elongated flanges 38 and 46 which extend the full length of the diffuser 10 and project laterally towards one another from the lower edges of the side walls 34 and 42. These flanges are in a common horizontal lane perpendicular to the side walls 34 and 42 and to the general airstream 18 in the diffuser 10. While the flanges 38 and 46 may be formed in various ways, in this instance each is a narrow sheet metal strip disposed beneath the lip at the lower edge of the associated diffuser side wall. The flanges 38 and 46 are secured to these lips or formed integrally with the side walls 34 and 42. The diffuser 10 is supported by inverted T bars 70 of the room ceiling and located on opposite sides of the diffuser 10.

The deflector vane 30 is made substantially narrower than the width of the passage 48 and is supported in the diffuser 10 for simple back and forth edgewise adjustment between laterally spaced alternate deflecting positions closely adjacent the respective diffuser side walls 34 or 42. In these two extreme positions, the vane defines alternate slot-like openings within the passage 48 above a respective flange 38 or 46. When the vane 30 is closely adjacent one side wall 34, the airstream 18 is directed along the opposite wall 42 for deflection in one direction by the associated flange 46, as shown by the dashed lines in FIG. 2. By sliding the vane 30 edgewise across the passage 48 and against the other wall 42, the direction of the airstream 18 into the room is reversed. These are the two available horizontal throw adjustments.

When the deflector vane is positioned between the two extreme positions the air passing over vane 30 and flanges 46 and 38 will have a vertical as well as a horizontal component. When the deflector vane is centered between the walls 34 and 42 the air discharged from slot 22 will be generally vertical.

Figure 3:
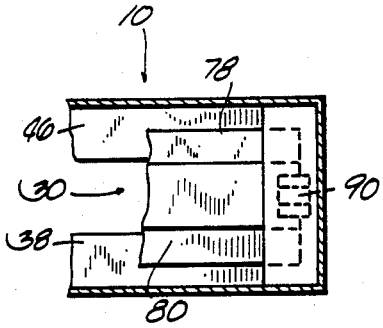
FIG. 3 is a top cross-sectional view taken along line 3—3 in FIG. 1.
Figure 4:
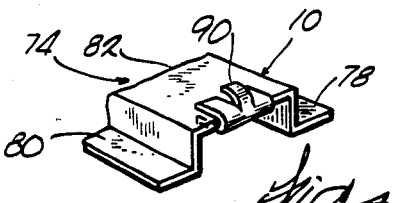
FIG. 4 is a perspective view of a deflector vane embodying various of the features of the invention.

As shown in FIG. 4, the deflector vane 30 is an elongated strip of sheet metal bent so as to include a central inverted U-shaped portion or channel 74 with outwardly extending flanges 78 and 80 extending away from each other from the open end of the U-shaped channel 74. As shown in FIGS. 2 and 3, the outwardly extending flanges 78 and 80 are in generally parallel relationship to the flanges 38 and 46 at the elongated outlet slot 22, and the vane 30 is wider than the outlet slot 22 so the airstream 18 directed around the deflector vane 30 impinges on the upper surface of the flange 38 or 46 before exiting the diffuser 10. In the preferred embodiment, the upper horizontal portion 82 of the central channel 74 equals approximately half of the width of the deflector vane 30.

The diffuser vane 30 has advantages over vanes used in earlier diffusers which vanes comprised essentially flat elongated sheets or channel-shaped metal members. The upstream or horizontal portion 82 of the inverted U-shaped channel 74 deflects airstream 18 across a flange 78 or 80 on one or both sides of the vane 30 and a side wall 34 or 42. As a result, the airstream is more fully directed generally perpendicular to the side wall 34 or 42 and in turn, more effectively turned by the upper surfaces of the flanges 38 and 46 before exiting the outlet slot 22 so the stream of air 18 can be more effectively deflected along the wall or ceiling of the room.

The flanges 78 and 80 also provide added rigidity to the deflector vane 30 limiting bending and vibration which can occur when a stream of air impinges upon a deflector vane. The added rigidity insures all portions of the deflector vane 30 remain in a preselected spacing from the flanges 38 and 46 defining the outlet slot 22 so the stream of air 18 is more properly directed as it exits the diffuser.

Figure 1:
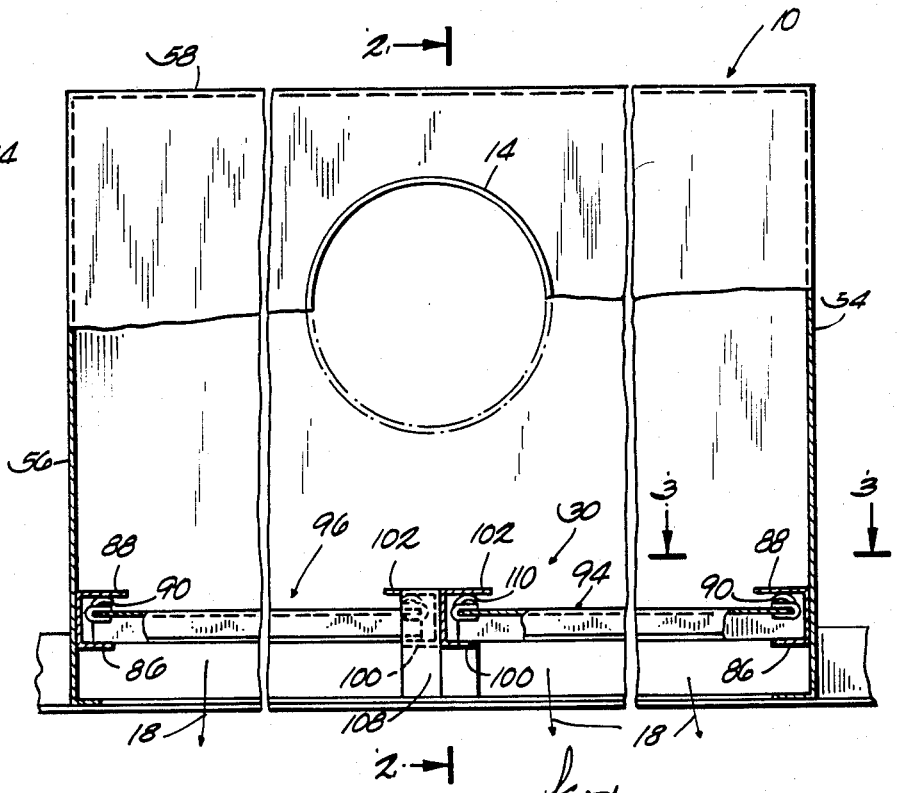
FIG. 1 is a side view of an air diffuser which embodies various of the features of the invention.

As shown in FIGS. 1, 2 and 3, the adjustable deflector vane 30 is mounted in the diffuser for sideways movement by a pair of spaced-apart horizontal ridges 86 and 88 on each of the end walls 54 and 56 of the diffuser 10. The flanges 78 and 80 of the deflector vane 30 sit on the lower ridge 86 and a spring 90 attached to the deflector vane 30 extends between the top 82 of the deflector vane 30 and the upper ridge 88. In this fashion, the deflector vane 30 rests on the lower ridge 86 and is held firmly in position by the spring 90 and upper ridge 88. The deflector vane 30 can slide along the lower ridge 86 and is held in place by the engagement of the spring 90 and the ridges 86 and 88.

As shown in FIG. 1, the deflector vane 30 can be split into identical deflector vane portions 94 and 96 arranged end-to-end in large diffuser boxes when air deflection in different directions from adjacent slot portions along the length of the diffuser 10 is desired. Each vane portion is mounted for individual movement relative to the other vane portion by having a pair of outwardly extending horizontal ridges 100 and 102 on each side of a support 108 disposed between the vane portions 94 and 96. The ridges 100 and 102 cooperate with springs 110 on the ends of the vane portions 94 and 96 to hold the vane portions 94 and 96 in position in a manner as previously described.

Figure 5:
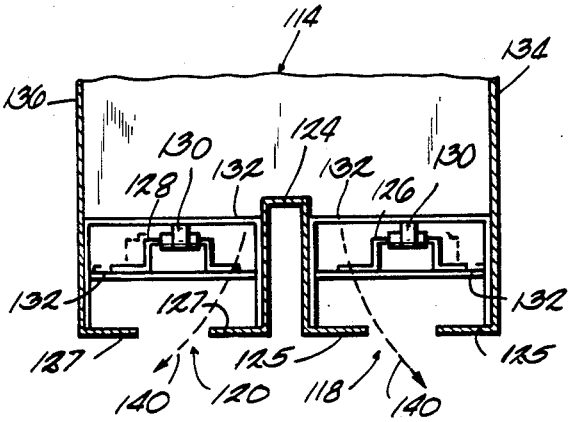
FIG. 5 is a cross-sectional view of a portion of another air diffuser embodying various of the features of the invention.

In an alternate embodiment, as shown in FIG. 5, an air diffuser 114 includes a pair of spaced apart elongated parallel outlet slots 118 and 120 separated by a central partition 124 and extending along the length of the air diffuser 114. The slots 118 and 120 are formed by pairs of flanges 125 and 127, in a manner as previously described. Deflector vanes 126 and 128 are identical to the deflector vane 30 previously described and are disposed above each of the outlet slots 118 and 120 and supported for sideways movement by springs 130 and ridges 132. The deflector vanes 126 and 128 can be positioned as described relative to vane 30 to achieve horizontal right and left throws, a vertical throw, or a combination thereof.

It is to be understood that the invention is not confined to the particular construction and arrangement of parts herein illustrated and described but embraces all such modified forms thereof as come within the scope of the following claims.

We claim:

1. An air diffuser comprising first and second walls disposed in spaced side-by-side relationship and cooperating to define a passage for the flow of air in one direction between said walls, a pair of flanges extending towards each other from the downstream edges of said walls and defining an elongated outlet slot narrower than the width of said passage, a deflector vane narrower than said passage and disposed in said passage in a plane spaced upstream from said slot and generally parallel to said flanges, said deflector vane including an inverted U-shaped central channel and flanges extending away from each other from the downstream ends of said U-shaped channel and generally parallel to said flanges defining said outlet slot, and means supporting said vane in said passage for back and forth edgewise movement in said plane parallel to said flanges and between a first position in which said vane is closely adjacent to said first wall and spaced from said second wall and a second position in which said vane is closely adjacent said second wall.

2. An air diffuser in accordance with claim 1 wherein said vane is wider than said slot.

3. An air diffuser in accordance with claim 1 wherein said vane comprises a plurality of individual vane portions mounted for individual adjustment to vary the direction of deflection of the air discharged along said air diffuser through said slot.

4. An air diffuser according to claim 1 wherein said support means is in said passage adjacent the longitudinal ends of said deflector vane for supporting said deflector vane for movement generally perpendicular to the longitudinal axis of said deflector vane and generally parallel to said plane, said support means each including first and second flange portions spaced apart in parallel fashion and the ends of said deflector vane being disposed between said last mentioned flange portions, the flanges of said deflector vane engaging one of said support means flanges for sliding movement thereon, said spring means engaged between the other of support means flanges and said deflector means for biasing the flanges of said deflector vane into engagement with said one of said support means flanges.

5. An air diffuser comprising first and second walls disposed in spaced side-by-side relationship and cooperating to define a passage for the flow of air in one direction between said walls, a partition secured between the downstream edges of said walls and forming a first passage between said partition and said first wall and a second passage between said partition and said second wall, a first pair of flanges extending towards each other from the downstream edges of said first wall and said partition and defining a first elongated outlet slot narrower than the width of said first passage, a first deflector vane narrower than said first passage and disposed in said first passage in a plane spaced upstream from said first slot and generally parallel to said first pair of flanges, said first deflector vane including an inverted U-shaped central channel and flanges extending away from each other from the downstream ends of said U-shaped channel and generally parallel to said first pair of flanges, means supporting said first vane in said first passage for back and forth edgewise movement in said plane parallel to said flanges and between a first position in which said first vane is closely adjacent to said first wall and spaced from said partition and a second position in which said first vane is closely adjacent said partition, a second pair of flanges extending towards each other from the downstream edges of said second wall and said partition and defining a second elongated outlet slot narrower than the width of said second passage, a second deflector vane narrower than said second passage and disposed in said second passage in a plane spaced upstream from said second slot and generally parallel to said second pair of flanges, said second deflector vane including an inverted U-shaped central channel and flanges extending away from each other from the downstream ends of said U-shaped channel and generally parallel to said second pair of flanges, and means supporting said second vane in said second passage for back and forth edgewise movement in said plane parallel to said flanges and between a first position in which said second vane is closely adjacent to said second wall and spaced from said partition and a second position in which said second vane is closely adjacent said partition.

6. An air diffuser in accordance with claim 5 wherein said first vane is wider than said first slot and wherein said second vane is wider than said second slot.

7. An air diffuser in accordance with claim 5 wherein said first vane comprises a first plurality of individual vane portions mounted for individual adjustment to vary the direction of deflection of the air discharged along said air diffuser through said first slot and wherein said second vane comprises a second plurality of individual vane portions mounted for individual adjustment to vary the direction of deflection of the air discharged along said air diffuser through said second slot.

8. An air diffuser according to claim 5 wherein said supporting means is in said passage adjacent the longitudinal ends of said deflector vane for supporting said deflector vane for movement generally perpendicular to the longitudinal axis of said deflector vane and generally parallel to said plane, said support means each including first and second flange portions spaced apart in parallel fashion and the ends of said deflector vane being disposed between said last mentioned flange portions, the flanges of said deflector vane engaging one of said support means flanges for sliding movement thereon, and spring means engaged between the other of support means flanges and said deflector means for biasing the flanges of said deflector vane into engagement with said one of said support means flanges.

* * * * *